US005816458A

United States Patent [19]

Yonenoi

[11] Patent Number: 5,816,458

[45] Date of Patent: Oct. 6, 1998

[54] HOLDERS FOR ARRANGEMENT OF SMALL GOODS

[75] Inventor: Kimio Yonenoi, Yokohama, Japan

[73] Assignee: Yonenoi Design Ltd., Tokyo, Japan

[21] Appl. No.: 800,423

[22] Filed: Feb. 14, 1997

[30] Foreign Application Priority Data

Feb. 16, 1996 [JP] Japan ..... 8-002043

[51] Int. Cl.[6] ..... A44B 15/00

[52] U.S. Cl. ..... 224/182; 24/3.13; 24/13; 24/300; 70/456 R; 224/254; 224/269

[58] Field of Search ..... 224/182, 254, 224/255, 256, 269, 5; 24/3.5, 3.6, 3.13, 13, 300; 63/1.18, 20; 70/457, 456 B, 456 R; 267/73, 74, 167

[56] References Cited

U.S. PATENT DOCUMENTS

| | | | |
|---|---|---|---|
| 681,934 | 9/1901 | Smith | 63/20 |
| 1,688,506 | 10/1928 | Rivers | 24/3.13 |
| 2,643,803 | 6/1953 | Bates | 224/254 |
| 3,328,986 | 7/1967 | Ralton | 70/456 R |
| 3,345,713 | 10/1967 | Gaupp | 24/3.6 X |
| 3,524,336 | 8/1970 | Crosby et al. | 70/457 |
| 4,821,543 | 4/1989 | Scungio | 70/456 R |

*Primary Examiner*—Renee S. Luebke

*Attorney, Agent, or Firm*—Armstrong, Westerman, Hattori, McLeland & Naughton

[57] ABSTRACT

A holder is provided for arrangement of small goods which includes: at least one pipe member with open opposite ends; at least one expandable/contractible curled cord which is substantially equal in length to the pipe member when the curled cord is in a contracted state, wherein the curled cord is received in the inside of the pipe member; holding rings for holding small goods, wherein the holding rings are attached at both ends of the curled cord so that the holding rings are located at both ends of the pipe member, respectively, and each of the holding rings have an outer diameter which is larger than an inner diameter of the pipe member; and an attachment member for attachment of the holder to external matter, wherein the attachment member is fixed to the pipe member.

13 Claims, 3 Drawing Sheets

HOLDERS FOR ARRANGEMENT OF SMALL GOODS

BACKGROUND OF THE INVENTION

1. Field of the Invention

The present invention generally relates to holders for holding small goods and more particularly, to a holder for functionally holding small personal articles, small operational goods, etc.

2. Description of the Related Art

Heretofore, various holders have been proposed for holding keys used as personal articles for various purposes or holding small articles, goods, etc. carried outdoors for fishing, camping, traveling, or similar.

Examples of conventional holders include: holders of a type in which a loop clutch or swivel is provided as an attachment member at one end of a curled cord, the curled cord being either an elastic cord of a synthetic resin material such as nylon or similar, or a rubber-containing elastic cord, and wherein a ring or a swivel, acting as a holding member, is attached to the other end of the curled cord; holders of a measuring-tape type in which one end of an ordinary cord or wire is attached to a built-in spring so that the cord or wire can be taken up automatically. As another example, the holder shown in FIG. 6 includes a curled cord having a holding member attached to a first end and fixed at a second opposed end to the inner bottom wall of a pipe casing which has a clip attached to an exterior thereof. Thus, the curled cord, to which small goods are attached by means of the holding member, can be expanded from the inside of the pipe casing when the small goods are in use. Furthermore, the curled cord is contracted so as to be received again in the inside of the pipe casing when the small goods are no longer in use.

These holders have their own effects and purposes but have various disadvantages and inconveniences in practical use as follows.

First, in any of the holders of the type mentioned above, the swivel or ring, which acts as a holding member for holding small goods, is provided only on one end portion of the expandable/contractible cord or expandable/contractible curled cord in view of its structure. Accordingly, although there is no problem when only one small article is used, there are some cases where problems may arise because various small goods are required to be held, for example, at the time of fishing or similar. At that time, one wears a fishing vest having a large number of pockets. In some cases, one may attach the aforementioned holder to such a vest in order to hold small goods. In these cases, if a plurality of small articles or goods are held in one holder, the plurality of articles or goods thus held are entangled with each other so that not only is it troublesome to select a necessary article from the plurality of articles or goods, but also it is difficult to handle the necessary article because the other articles or goods become obstacles to use of the necessary article.

Therefore, in most cases, holders are prepared by the number corresponding to the number of the required small goods. In these cases, there arises a disadvantage in that not only the weight of the vest becomes heavy, but also a great deal of labor is required for searching the holders because the number of holders used is increased.

Further, the holder of the measuring-tape type or the holder of the type in which the curled cord is received in the casing, has such a function that the cord does not become an obstacle because the cord is received in the casing when the small goods are not in use. However, because one end portion of the expandable/contractible member is fixed to the inside of the casing, the number of holding portions for holding small goods is limited to only one. Accordingly, it is conventionally impossible to effectively hold a plurality of articles or goods because only one holder is present.

SUMMARY OF THE INVENTION

An object of the present invention is to solve the aforementioned disadvantages and inconveniences of conventional holders to thereby provide a holder easy to handle.

In order to achieve the above described object, according to an aspect of the present invention, a holder for arrangement of small goods comprises: at least one pipe member with open opposite ends; at least one expandable/contractible curled cord substantially equal in length to the pipe member when the curled cord is in a contracted state, the curled cord being received in the inside of the pipe member; holding rings for holding small goods, the holding rings being attached at both ends of the curled cord so that the holding rings are located at both ends of the pipe member, respectively, each of the holding rings having an outer diameter larger than an inner diameter of the pipe member; and an attachment member fixed to the pipe member for attachment of the holder to external matter.

In the above-described holder, the pipe member may be straight in external appearance so that the ends of the pipe member are located in opposition to each other.

In the above-described holder, the pipe member may be U-shaped in external appearance so that the ends of the pipe member are located side-by-side at positions adjacent to each other.

In the above-described holder, the pipe member may have an S-shaped cross-section so that the member has a pair of curled-cord receiving portions,each receiving a curled cord such that the holder has a total of four holding rings.

In the above-described holder, the attachment member may be a safety pin.

In the above-described holder, the attachment member may be a swivel.

In the above-described holder, the attachment member may be a clip.

Accordingly, even in the case where only one curled cord is received in the pipe member, not only a plurality of small goods or articles can be held by means of the holding rings provided on both ends of the curled cord, but also the curled cord can be expanded/contracted freely so that the small goods can be used easily.

In the holder of the type having a straight appearance, the curled cord is received in the inside of the straight pipe member through the open opposite ends of the pipe member and the holding rings for holding small goods are attached to the opposite end portions of the curled cord located at the open opposite ends of the pipe member. Accordingly, a plurality of small goods can be held separately at the opposite ends of the holder so that the small goods can be selected easily for use. That is, the holder is easy to handle because the small goods are prevented from being entangled with each other. Although the opposite end portions of the receiving pipe member are open, the curled cord never comes out of the pipe member even though the curled cord is expanded when small goods attached to either one of the holding rings are used, because the diameter of each of the holding rings attached to the opposite end portions of the curled cord is larger than the inner diameter of the pipe member. That is, even if the curled cord is pulled on so as to expand because one of the holding rings is in use, the other holding ring serves as a stopper to prevent the curled cord from coming out of the pipe member.

Further, in the holder of the type having a U-shaped appearance, the holding rings provided on both ends of the curled cord are located side-by-side in positions adjacent to each other. Accordingly, in the case where small good are attached to the holder, the pipe member can be held stably, particularly when in a position so as to be hanging down and the small goods are easy to handle.

In addition, in a holder of the type having a pipe member which is S-shaped in cross-section, the holder has a structure in which there are two curled-cord receiving portions even though the pipe member is formed of one part. According, because two curled cords can be received in the curled-cord receiving portions, the number of holding rings attached to the end portions of the curled cords is doubled as compared with the previous type holder. Accordingly, a holder is provided in which a large number of small goods can be held.

BRIEF DESCRIPTION OF THE DRAWING FIGURES

DESCRIPTION OF THE PREFERRED EMBODIMENTS

Referring to the accompanying drawing figures, preferred embodiments of the present invention will be described below in detail.

First Embodiment

Figure 1:
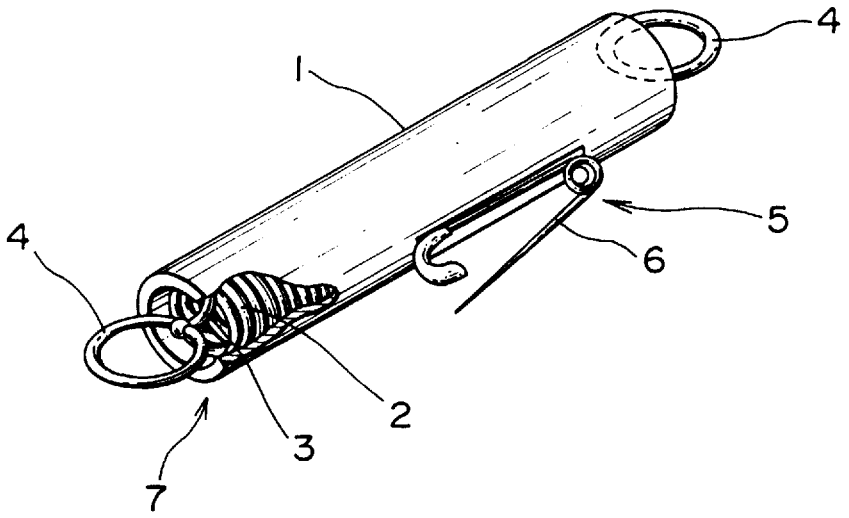
FIG. 1 is a partly cutaway perspective view showing a first embodiment of the present invention.
Figure 2:
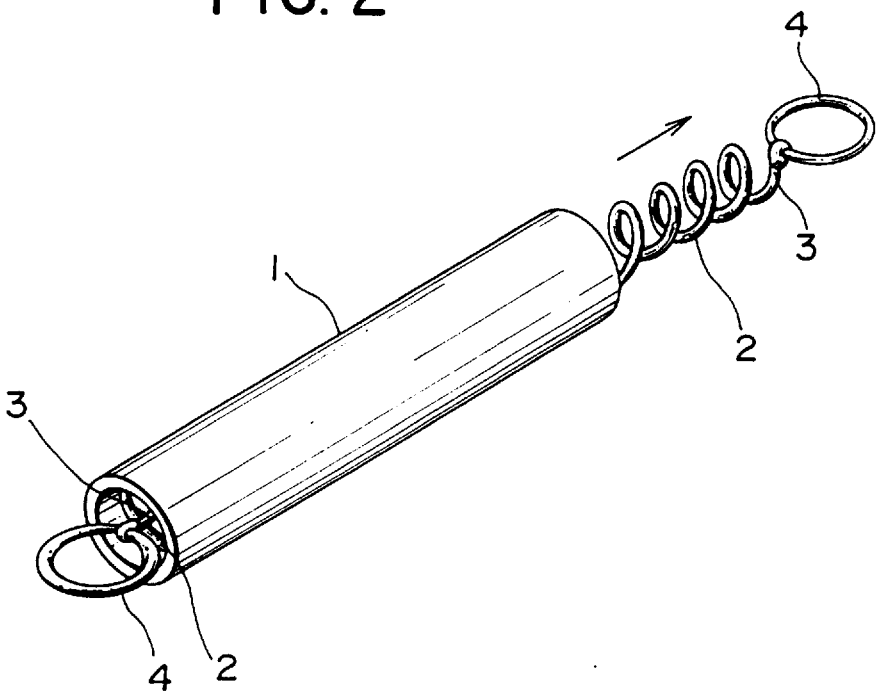
FIG. 2 is a view showing an example in which the curled cord depicted in FIG. 1 is in an expanded state.

The first embodiment of the holder according to the present invention will be described below with reference to FIG. 1 which is a partly cutaway perspective view and FIG. 2 which is a view showing an example of the first embodiment in which the curled cord is in an expanded state.

The holder 7 of the first embodiment includes: a straight pipe member 1 having a suitable length and a suitable inner diameter, for example, about 7 to 8 mm; a curled cord 2, made from a synthetic resin material such as nylon or similar, is received in the inside of the pipe member 1; a pair of holding rings 4, 4, wherein each holding ring 4 has an outer diameter larger than the inner diameter of the pipe member 1 and each holding ring 4 is attached to the opposite ends 3, 3 of the curled cord 2; and a safety pin 6, attached to a part of the outside of the pipe member 1, so as to act as an attachment member 5 to be attached to clothing or similar. The curled cord 2 has a length substantially equal to the length of the pipe member 1 when the curled cord 2 is in its non-expanded or contracted state. The curled cord 2 has an outer diameter which is large enough to be received in the inside of the inner diameter of the pipe member 1. Each of the holding rings 4, 4 has a diameter larger than the inner diameter of the pipe member 1. Furthermore, each of the holding rings 4, 4 are attached to the opposite ends 3, 3, respectively, of the curled cord 2, after the curled cord 2 is received in the pipe member 1. Thus, the holding rings 4, 4 are prevented, by the ends of the pipe member 1, from entering the inside of the pipe member 1.

Since the holding rings 4, 4, which are capable of holding small goods or articles, are larger in diameter than the inner diameter of the open opposite ends of the pipe member 1, the holding rings 4, 4 are prevented from entering the inside of the pipe member 1 and are made to stay at the end positions of the pipe member 1 when in their normal position. Accordingly, small goods can be attached to either one of the holding rings 4, 4, when the small goods are to be attached to only one side of the pipe member 1 of the holder, and also small goods can be attached to the holding rings 4, 4, when the small goods are to be attached to the opposite end sides, respectively, of the pipe member 1. When small goods are held by only one of the holding rings 4, 4 on one end side of the pipe member 1, the curled cord 2 never comes out from the one end side of the pipe member 1, even in the case where the curled cord 2 is pulled on so as to be expanded outwardly from the one end side of the pipe member 1 due to the other holding ring 4 acting as a stopper. When small goods are held by both of the holding rings 4, 4 disposed on the opposite end portions of the pipe member 1 of the holder, if the small goods held by either one of the holding rings 4, 4 are used so as to expand the curled cord toward the one holding ring side, the curled cord 2 never comes out from the pipe member 1, because the curled cord 2 is prevented from coming out by the other holding ring 4 which acts as a stopper. In either case, when one releases his/her fingers from the small goods in a state where the curled cord 2 is expanded, the curled cord 2 is automatically contracted so as to be received within the pipe member 1 speedily and compactly.

Second Embodiment

Figure 3:
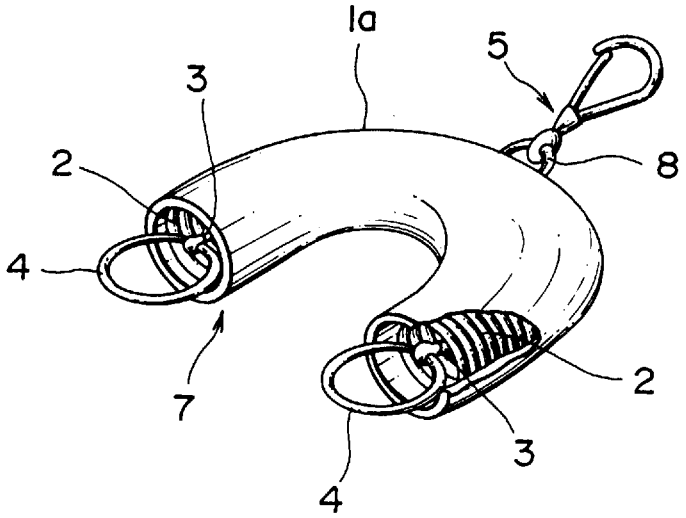
FIG. 3 is a partly cutaway perspective view showing a second embodiment of the present invention.
Figure 4:
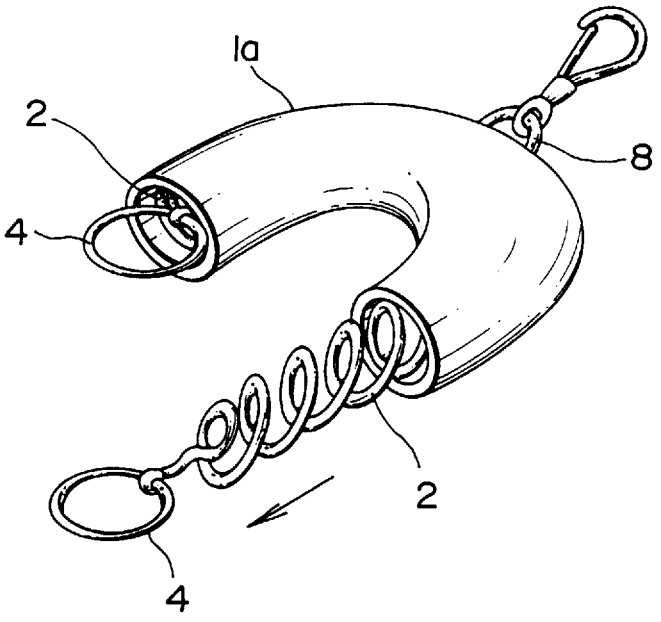
FIG. 4 is a view showing an example in which the curled cord depicted in FIG. 3 is in an expanded state.

The second embodiment will be described below with reference to FIG. 3, which is a partly cutaway perspective view, and FIG. 4, which is a view showing an example of the second embodiment in which the curled cord is expanded. In FIGS. 3 and 4, the same reference numerals are given to those structures in FIGS. 1 and 2, which are similar or equivalent and a detailed description of those similar or equivalent structures will be omitted here for the sake of simplicity of description.

The first embodiment shows the case where the pipe member 1 is straight and the second embodiment show the case where a pipe member 1*a* has a U-shaped external appearance. In the holder 7 of the second embodiment, the curled cord 2 has end portions 3, 3, which are attached to the holding rings 4, 4 and which are located at the open opposite ends of the pipe member 1*a*, respectively. The curled cord 2 is received in the inside of the pipe member 1*a*. An attachment member 5, such as a loop clutch or swivel 8, is attached to a part of the outside of the pipe member 1*a*.

Because the pipe member 1*a* has a U-shaped external appearance in the second embodiment, the holder is configured so that the holding rings 4, 4, provided on both the end portions of the pipe member 1*a*, are suitably arranged side-by-side in positions adjacent to each other. Accordingly, because small goods or articles, which are held by the holding rings 4, 4 attached on both end portions 3, 3 of the curled cord 2, respectively, are located side-by-side in positions adjacent to each other, the holder 7 can not only be held stably, particularly when the holder 7 hangs down, but the holder 7 of the second embodiment can also be handled more easily than the holder 7 of the first embodiment, when the curled cord 2 is expanded to use small goods held by one of the holding rings 4, 4.

When the pipe member 1*a* has a U-shaped external appearance as described above, the length of the holder 7 can be made more compact, even in the case where the degree of expansion of the curled cord 2 is set to be larger so as to make the curled cord 2 easy to handle, as compared with the first embodiment in which the pipe member 1 has a straight external appearance so that the length of the holder 7 must be set to be undesirably large.

Third Embodiment

Figure 5:
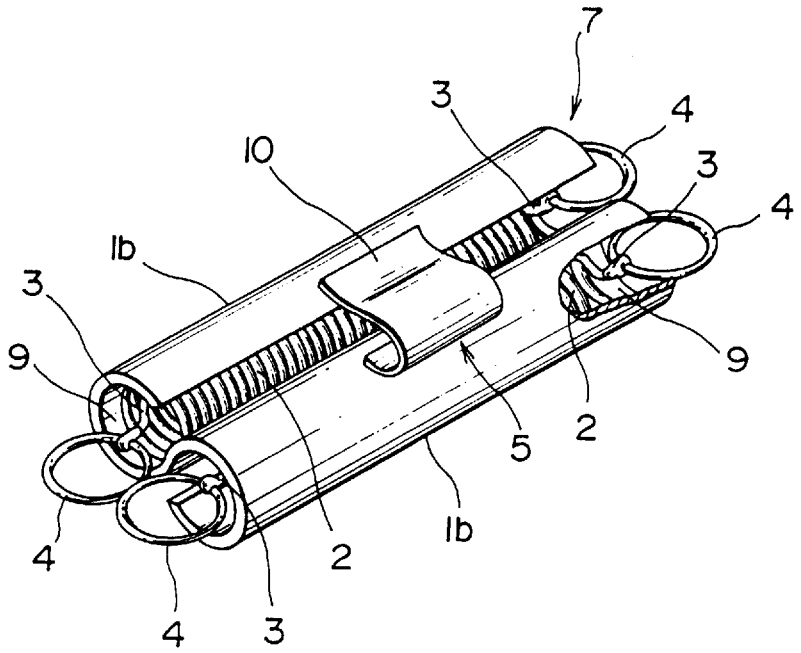
FIG. 5 is a partly cutaway perspective view showing a third embodiment of the present invention.
Figure 6:
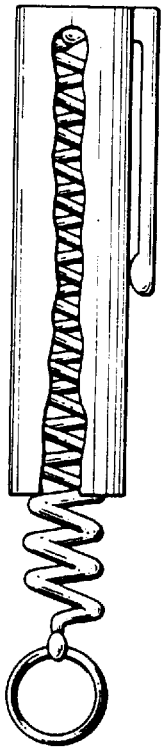
FIG. 6 PRIOR ART
FIG. 6 is a cutaway view showing a conventional holder as an comparative example.

The third embodiment will be described below with reference to FIG. 5 which is a partly cutaway perspective view. In FIG. 5, the same reference numerals will be given to those structures in FIGS. 1 and 2 which are similar or equivalent and a detailed description of those similar or equivalent structures will be omitted here for the sake of simplicity of description.

In the holder 7 of the third embodiment, a double pipe member 1*b*, having an S-shaped cross-section so as to have two receiving portions 9, 9, is used so that a pair of curled cords 2, 2, each having opposite end portions 3, 3 attached to holding rings 4, 4, respectively, are received in the two receiving portions 9, 9, respectively. Further, a clip 10, which acts as an attachment member 5, is attached to a part of the outside of the double pipe member 1*b*.

Because the holder 7 of the third embodiment includes the double pipe member 1*b*, which has two receiving portions 9, 9 even though the body of the holder 7 is formed from one part, two curled cords 2, 2 are received within the pipe member 1*b*. Accordingly, two holding rings 4, 4 are attached to the opposite ends 3, 3 of each of the curled cords 2, 2. In other words, four holding rings 4, 4 in total are attached to the opposite ends 3, 3 of the curled cords 2, 2 so that the holder 7 can hold twice as many small goods or articles. Incidentally, the double pipe member 1*b* may be U-shaped in external appearance similar to the second embodiment. Further, in order to provide tow or more receiving portions 9, 9, . . . such a pipe member, having an S-shaped cross-section, may be replaced by two or more single-type pipe members, wherein each of the single-type pipe members is similar to the pipe member of the first or second embodiment and each of the single type pipe members are put side-by-side and fixed to each other.

In the first, second and third embodiments according to the present invention, either metal pipe or synthetic resin pipe may be used as a material for pipe members 1, 1*a*, 1*b* for receiving the curled cords 2. Further, for example, each end of the pipe member 1, 1*a*, 1*b* used in the present invention may be shaped like a trumpet so that the holding rings 4, 4, may partly enter into the pipe member. Although the first, second and third embodiments have been described wherein the curled cords are used as expandable/contractible connection cord members, the invention can be applied to the case where any other expandable/contractible connection members such as highly expandable/contractible shock cords or similar may be used. In addition, any suitable material may be used for the attachment member 5 for attaching the holder 7 to clothing or similar.

Because the holder, according to the present invention, is configured in such a manner as described above, the following effects and advantages can be provided.

Because the holding rings, which are attached to the opposite end portions of the curled cord received in the pipe member for holding goods, are located at the opposite end portions of the pipe member, the small goods can be held separately in two holding portions of one holder. Accordingly, the small goods can be selected easily when the small goods are to be put into use, so that the small goods become easy to handle. Furthermore, even in the case where only one of the holding rings is used at a time, the curled cord may be expanded by a predetermined length when the small goods held by the one holding ring are in use, and the curled cord can be contracted again automatically and speedily so as to be received in the inside of the pipe member compactly after completion of use of the small goods. Further, when, for example, the holder of the straight-type pipe members is to be attached to a vest, the holder can be attached to the lower portion of a breast pocket of the vest or similar, for the combined purposes of good fitting and good appearance so that the holder is made easy to handle.

Further, in the holder of a unique type pipe member having a U-shaped external appearance, according to the present invention, the two holding rings are located side-by-side in positions adjacent to each other. Accordingly, not only can the holder be held stably, particularly when the holder hangs down, but also the holder is easy to handle when small goods are in use. In addition, in the holder having a pipe member of an S-shaped cross-section so as to include two receiving portions, two curled cords can be received in the two receiving portions, respectively, so that there are four rings in total for holding small goods. In other words, the number of small goods to be held is twice the number of a single-type holder. In addition, because either a single-type holder or a double-type holder is simply configured, the holder can be utilized as a functionally powerful holder for arrangement of small goods such as when fishing, wherein not only are a large number of small goods required, but also the holder is required to be easy to handle in a bad foothold location.

In addition, because the holder of the present invention is configured so that the number of constituent members is small, the holder for arrangement of small goods can be provided at a low cost.

It is claimed:

1. A holder for arrangement of small goods comprising:

at least one pipe member having first and second ends, wherein both said first and second ends have an opening therein;

at least one expandable/contractible curled cord having first and second ends expandable so as to extend outwardly from said first and second ends of said pipe member, respectively, wherein said curled cord is substantially equal in length to said pipe member when said curled cord is in a fully contracted state, said curled cord is entirely received in an inside of said pipe member when in said contracted state, and said curled cord extends outwardly through said first and second openings of said first and second ends of said pipe member, respectively, when in a fully expanded state;

holding rings for holding small goods, said holding rings being entirely closed annular members with no gaps which are attached at both said first and second ends of said curled cord so that said holding rings are located at both said first and second opposite ends of said pipe member, respectively, each of said holding rings having an outer diameter larger than an inner diameter of said pipe member;

an attachment member fixed to said pipe member for attachment of said holder to an external matter; and wherein said pipe member is straight in external appearance so that said first and second ends of said pipe member are located to be in opposition to each other.

2. The holder for arrangement of small goods according to claim 1, wherein said attachment member includes a safety pin.

3. The holder for arrangement of small goods according to claim 1, wherein said attachment member includes a swivel.

4. The holder for arrangement of small goods according to claim 1, wherein said attachment member includes a clip.

5. A holder for arrangement of small goods comprising:

at least one pipe member having first and second ends, wherein both said first and second ends have an opening therein;

at least one expandable/contractible curled cord having first and second ends expandable so as to extend outwardly from said first and second ends of said pipe member, respectively, wherein said curled cord is substantially equal in length to said pipe member when said curled cord is in a fully contracted state, said curled cord is entirely received in an inside of said pipe member when in said contracted state, and said curled cord extends outwardly through said first and second openings of said first and second ends of said pipe member, respectively, when in a fully expanded state;

holding rings for holding small goods, said holding rings being entirely closed annular members with no gaps which are attached at both said first and second ends of said curled cord so that said holding rings are located at both said first and second opposite ends of said pipe member, respectively, each of said holding rings having an outer diameter larger than an inner diameter of said pipe member;

an attachment member fixed to said pipe member for attachment of said holder to an external matter; and wherein said at least one expandable/contractible curled cord includes first and second curled cords, wherein said pipe member has an S-shaped cross-section so that said pipe member has first and second curled-cord receiving portions for receiving said first and second curled cords therein, respectively, whereby said first and second curled cords each have first and second ends being attached to holding rings so that said holder has a total of four said holding rings.

6. The holder for arrangement of small goods according to claims 5, wherein said attachment member includes a safety pin.

7. The holder for arrangement of small goods according to claim 5, wherein said attachment member includes a swivel.

8. The holder for arrangement of small goods according to claim 5, wherein said attachment member includes a clip.

9. A holder for arrangement of small goods comprising:

at least one pipe member having first and second ends, wherein both said first and second ends have an opening therein;

at least one expandable/contractible curled cord having first and second ends expandable so as to extend outwardly from said first and second ends of said pipe member, respectively, wherein said curled cord is substantially equal in length to said pipe member when said curled cord is in a fully contracted state, said curled cord is entirely received in an inside of said pipe member when in said contracted state, and said curled cord extends outwardly through said first and second openings of said first and second ends of said pipe member, respectively, when in a fully expanded state;

holding rings for holding small goods, said holding rings being entirely closed annular members with no gaps which are attached at both said first and second ends of said curled cord so that said holding rings are located at both said first and second opposite ends of said pipe member, respectively, each of said holding rings having an outer diameter larger than an inner diameter of said pipe member;

an attachment member fixed to said pipe member for attachment of said holder to an external matter;

wherein said pipe member is U-shaped in external appearance so that said first and second ends of said pipe member are located side by side at positions adjacent to each other; and wherein said attachment member includes any one of a group consisting of a safety pin, a swivel, and a clip.

10. A holder for arrangement of small goods comprising:

at least one pipe member having first and second ends, wherein both said first and second ends have an opening therein;

at least one expandable/contractible curled cord having first and second ends expandable so as to extend outwardly from said first and second ends of said pipe member, respectively, wherein said curled cord is substantially equal in length to said pipe member when said curled cord is in a fully contracted state, said curled cord is entirely received in an inside of said pipe member when in said contracted state, and said curled cord extends outwardly through said first and second openings of said first and second ends of said pipe member, respectively, when in a fully expanded state;

holding rings for holding small goods, said holding rings being entirely closed annular members with no gaps which are attached at both said first and second ends of said curled cord so that said holding rings are located at both said first and second opposite ends of said pipe member, respectively, each of said holding rings having an outer diameter larger than an inner diameter of said pipe member;

an attachment member fixed to said pipe member for attachment of said holder to an external matter; and wherein said attachment member includes any one of group consisting of a safety pin, a swivel, and a clip.

11. The holder for arrangement of small goods according to claim 10, wherein said pipe member is straight in external appearance so that said first and second ends of said pipe member are located to be in opposition to each other.

12. The holder for arrangement of small goods according to claim 10, wherein said pipe member is U-shaped in external appearance so that said first and second ends of said pipe member are located side by side at positions adjacent to each other.

13. The holder for arrangement of small goods according to claim 10, wherein said at least one expandable/contractible curled cord includes first and second curled cords, wherein said pipe member has an S-shaped cross-section so that said pipe member has first and second curled-cord receiving portions for receiving said first and second curled cords therein, respectively, whereby said first and second curled cords each have first and second ends being attached to holding rings so that said holder has a total of four said holding rings.

* * * * *